US010641222B2

(12) United States Patent
Serra et al.

(10) Patent No.: US 10,641,222 B2
(45) Date of Patent: May 5, 2020

(54) FUEL INJECTOR ASSEMBLY

(71) Applicant: Continental Automotive GmbH, Hannover (DE)

(72) Inventors: Giandomenico Serra, Ghezzano-S.Giuliano Terme (IT); Davide Matteini, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 16/313,241

(22) PCT Filed: Jun. 30, 2017

(86) PCT No.: PCT/EP2017/066289
§ 371 (c)(1),
(2) Date: Dec. 26, 2018

(87) PCT Pub. No.: WO2018/002310
PCT Pub. Date: Jan. 4, 2018

(65) Prior Publication Data

US 2019/0153986 A1 May 23, 2019

(30) Foreign Application Priority Data

Jun. 30, 2016 (EP) ..... 16177266

(51) Int. Cl.
*F02M 61/14* (2006.01)
*F02M 55/02* (2006.01)

(52) U.S. Cl.
CPC ..... *F02M 61/14* (2013.01); *F02M 55/025* (2013.01); *F02M 2200/803* (2013.01);
(Continued)

(58) Field of Classification Search
CPC .. F02M 61/14; F02M 55/025; F02M 2200/85; F02M 2200/9053;
(Continued)

(56) References Cited

U.S. PATENT DOCUMENTS 8,424,509 B1 4/2013 Davis ..... 123/470
2006/0118091 A1* 6/2006 Zdroik ..... F02M 61/14 123/470
(Continued)

FOREIGN PATENT DOCUMENTS

CN 102345544 A 2/2012 ..... F02B 75/22
DE 44 13 415 C1 6/1995 ..... F02M 61/14
(Continued)

OTHER PUBLICATIONS

Extended European Search Report, Application No. 16 177 266.0, 6 pages Nov. 22, 2016.
(Continued)

*Primary Examiner* — Joseph J Dallo
(74) *Attorney, Agent, or Firm* — Slayden Grubert Beard PLLC

(57) ABSTRACT

Various embodiments include a fuel injector assembly for an internal combustion engine comprising: an injector cup; a securing device to fasten the injector cup to the engine; wherein a first end of the injector cup remote from the fuel inlet port comprises an outwardly extending flange; a connector abutting the flange, wherein the injector cup and the fuel injector are secured together through the connector; and a fastening bracket supported on the flange, wherein the injector cup and the connector are secured through the fastening bracket by a fastening device. The fastening device comprises a U-shaped clip with a first arm disposed between a clamping face of the fastening device and the fastening
(Continued)

bracket and a second arm generally parallel to the first arm disposed on the opposite side of the fastening bracket.

11 Claims, 1 Drawing Sheet

(52) U.S. Cl.
CPC . *F02M 2200/8023* (2013.01); *F02M 2200/85* (2013.01); *F02M 2200/855* (2013.01); *F02M 2200/9038* (2013.01); *F02M 2200/9053* (2013.01)

(58) Field of Classification Search
CPC ... F02M 2200/9038; F02M 2200/8023; F02M 2200/803; F02M 2200/855
See application file for complete search history.

(56) References Cited

U.S. PATENT DOCUMENTS

| | | | | |
|---|---|---|---|---|
| 2006/0137659 | A1* | 6/2006 | Zdroik | F02M 55/005 123/470 |
| 2012/0017875 | A1 | 1/2012 | Ishiki et al. | 123/468 |
| 2012/0204837 | A1* | 8/2012 | Harvey | F02M 55/02 123/469 |
| 2015/0316015 | A1* | 11/2015 | Badarinarayan | F02M 63/0275 123/456 |
| 2017/0022951 | A1* | 1/2017 | Serra | F02M 55/005 |
| 2017/0248108 | A1* | 8/2017 | Di Domizio | F02M 55/005 |
| 2018/0038331 | A1* | 2/2018 | Carli | F02M 55/005 |

FOREIGN PATENT DOCUMENTS

| | | | | |
|---|---|---|---|---|
| EP | 1 967 728 | A1 | 9/2008 | F02M 55/00 |
| EP | 1 967 728 | B1 | 10/2009 | F02M 55/00 |
| EP | 2 241 746 | A1 | 10/2010 | F02M 55/00 |
| WO | 2018/002310 | A1 | 1/2018 | F02M 55/02 |

OTHER PUBLICATIONS

International Search Report and Written Opinion, Application No. PCT/EP2017/066289, 11 pages, dated Aug. 25, 2017.

* cited by examiner

FUEL INJECTOR ASSEMBLY

CROSS-REFERENCE TO RELATED APPLICATIONS

This application is a U.S. National Stage Application of International Application No. PCT/EP2017/066289 filed Jun. 30, 2017, which designates the United States of America, and claims priority to DE Application No. 16177266.0 filed Jun. 30, 2016, the contents of which are hereby incorporated by reference in their entirety.

TECHNICAL FIELD

The present disclosure relates to internal combustion engines. Various embodiments may include a system for mechanically and hydraulically coupling a fuel injector cup to a fuel injector and to a fuel injector cup assembly for an internal combustion engine.

BACKGROUND

Fuel injectors are widely used in internal combustion engines where they are arranged in order to inject fuel into an intake manifold of the internal combustion engine or directly into a combustion chamber of a cylinder of the internal combustion engine. The fuel injectors of a multi-cylinder internal combustion engine are connected to a fuel source known as a common rail to which each of the fuel injectors is hydraulically and mechanically connected through a fuel injector cup. The injector cup itself is connected to the common rail through a supply pipe, through which fuel under high-pressure is supplied to the fuel injector via the cup.

Such cup assemblies are known from the prior art, see for example, U.S. Pat. No. 8,424,509. The cup is adapted to receive the inlet end of a fuel injector on the downstream side of the cup opposite the fuel pipe. Because of the high pressures involved in the fuel injection, there is a need for a clamping force to secure the fuel injector to the injector cup. In these known arrangements, the inlet end of the fuel injector is located in the injector cup and is hydraulically sealed by means of a sealing ring on the injector which engages with the injector cup.

The fuel injector is secured to the engine and the injector cup is also secured to the engine but inevitably the point at which the injector cup is secured to the engine is spaced from the axis of the injector cup and the injector. The pressure of fuel injection tends to urge the injector cup away from the fuel injector and the consequence is that a bending moment is imposed in the connection which tends to separate the connection between the injector cup and the fuel injector. This not only adversely affects performance but can also cause separation between the connector injector cup and the fuel injector particularly with the risk that the injector can be moved to such an extent that the sealing ring can project out of the injector cup with the risk of substantial damage. The prior attempts to minimise this risk result in a substantial construction for the injector cup and also the provision of a flexible clamp arrangement which generates a bending moment in the opposite direction to the bending moment caused by the fluid pressure.

CN 102345544 A provides a fuel supply system of a Vee engine, which reduces the stress applied on an end part of a connecting pipe connecting between a high pressure fuel pump and a transmission pipe. The fuel inflated by a high pressure fuel pump is distributed on a plurality of ejectors arranged on a first cylinder set and a second cylinder set via a first connecting pipe and a second connecting pipe and a first transmission pipe and a second transmission pipe. Because direction of a connecting part at a high pressure fuel pump side of the first connecting pipe and the second connecting pipe is generally consistent with the direction of thermal expansion of the first cylinder set and the second cylinder set, even though the position of the connecting part at the first transmission pipe and the second transmission pipe sides of the first connecting pipe and the second connecting pipe is moved due to the influence of thermal expansion, large stress generated at the connecting part at the high pressure fuel pump side can be avoided; and endurance of the first connecting pipe and the second connecting pipe can be increased.

EP 1967728 B1 discloses a coupling device for hydraulically coupling a fuel injector to a fuel rail of a combustion engine comprising a fuel injector cup being designed to engage a fuel inlet portion of the fuel injector, and a tube with a first end and a second end, the first end being coupleable to the fuel rail and the second end being coupled to the fuel injector cup.

SUMMARY

The teachings of the present disclosure describe a different design in which the injector cup is secured directly to the fuel injector by a clamping arrangement which obviates the bending moments and which provides a much lighter and cost-effective solution to the connection between the injector cup and the fuel injector. For example, some embodiments include a fuel injector assembly for an internal combustion engine, the assembly having an injector cup (4) with an internal volume (10) adapted to receive a fuel inlet end of a fuel injector (5), and a fuel inlet port (16) hydraulically connectable to a fuel source and in fluid communication with the volume (10), a securing device (18) by which the injector cup (4) is fastened to the engine, the end of the injector cup (4) remote from the fuel inlet port (16) having an outwardly extending flange (20), characterised in that the fuel injector assembly further comprising a connector (22) abutting the flange (20), through which the injector cup (4) and the fuel injector (5) are secured together, and a fastening bracket (24), supported on the flange (20), through which the injector cup (4) is secured to the connector (22) by at least one fastening device (34) wherein the or each fastening device has a U-shaped clip (36) having a first arm (38) disposed between a clamping face of the fastening device and the fastening bracket (24) and a second arm (42) generally parallel to the first arm (38) disposed on the opposite side of the fastening bracket (24).

In some embodiments, the second arm (42) is disposed on the opposite side of the fastening bracket (24) between the fastening bracket (24) and the connector (22).

In some embodiments, the connector (22) is part of the fuel injector (5) and in particular blocks axial displacement of the fuel inlet end of the fuel injector (5) with respect to the injector cup (4) in direction away from the fuel inlet port (16).

In some embodiments, there are two fastening devices (34) located on opposed sides of the injector cup (4).

In some embodiments, the or each fastening device (34) comprises a bolt, the first arm (38) being disposed between the bolt head (40) and the fastening bracket (10).

In some embodiments, the or each first arm (38) has an opening (44) through which the bolt (34) passes.

In some embodiments, the second arm (42) is shorter than the first arm (38) and has at its free end a recess (46) aligned with the opening (44) in the first arm (38).

In some embodiments, the recess (46) is arcuate.

In some embodiments, the clip (36) is formed of a resilient material.

In some embodiments, the clip (36) is formed of stainless steel or a coated carbon steel.

In some embodiments, the fastening bracket (24) has a central opening (26) which fits over the main body part (8) of the injector cup (4) to abut the flange (20) so that the inner periphery (30) of the fastening bracket (24), defined by the central opening (26), lies on the flange (20), the outer periphery (32) of the fastening bracket having a greater thickness than the inner periphery (30), the clip (36) being located so that the second arm (42) is located between the thicker outer periphery (32) of the fastening bracket (24) and the fuel injector connector (22).

BRIEF DESCRIPTION OF THE DRAWINGS

An example embodiment of the teachings herein is described by way of example with reference to the accompanying drawings in which.

DETAILED DESCRIPTION

Figure 1:
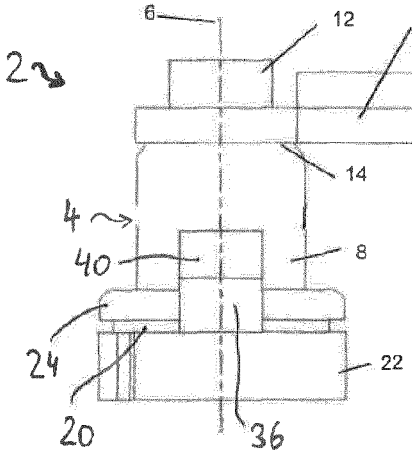
FIG. 1 shows a side view of a fuel injector cup assembly incorporating teachings of the present disclosure.

Some embodiments include a fuel injector assembly for an internal combustion engine. The assembly may have an injector cup with an internal volume adapted to receive a fuel inlet end of a fuel injector, and a fuel inlet port hydraulically connectable to a fuel source and in fluid communication with the volume, a securing device by which the injector cup is fastened to the engine. The assembly also comprises the fuel injector.

In some embodiments, the assembly further comprises a connector through which the injector cup and the fuel injector are secured together, and a fastening bracket, through which the injector cup is secured to the connector. The end of the injector cup remote from the fuel inlet port has an outwardly extending flange arranged to support the fastening bracket and to abut the connector. To put it differently, the connector is fixed to the injector cup by means of the fastening bracket and the fastening device. The fastening device presses the fastening bracket and the connector against opposite sides of the flange of the injector cup. The connector may be, for example, a connecting plate which may have an aperture through which the fuel inlet of the injector extends into the internal volume of the injector cup. Preferably, the connector is a part of the fuel injector.

The connector—when secured to the injector cup—is in particular configured and arranged to block axial displacement of the fuel inlet of the fuel injector out of the injector cup. For example, axial displacability of the connector with respect to the fuel inlet end of the fuel injector may be limited by a snap ring engaging into form-fit connection with each of the fuel inlet end and the connector.

In some embodiments, the injector cup is secured to the connector by at least one fastening device. In particular, the fastening device is fixed to the connector, e.g. by means of a threaded connection, secures the injector cup to the connector by means of a form-fit connection between the fastening device and the fastening bracket and by a form-fit connection between the fastening bracket and the flange. The fastening device or each fastening device has a U-shaped clip having a first arm disposed between a clamping face of the fastening device and the fastening bracket and a second arm generally parallel to the first arm disposed on the opposite side of the fastening bracket.

In some embodiments, the second arm is disposed on the opposite side of the fastening bracket between the fastening bracket and a connector of the fuel injector. In some embodiments, the bending moments imposed on the fuel injector assembly by the designs of the prior art are substantially eliminated which enables a much more compact, lightweight construction which offers significant savings in materials and manufacturing costs. The U-shaped clip, i.e. a clip with a U-shaped cross-section, limits the inclination of the clamping face of the fastening device, so that it may also be called an "inclination limiter".

In some embodiments, a plurality of fastening devices are disposed about the injector cup, and a further embodiment has two fastening devices located on opposed sides of the injector cup In some embodiments, the or each fastening device comprises a bolt, the first arm being disposed between the bolt head and the fastening bracket. The above-mentioned clamping face of the fastening device is in this case in particular a bottom face of the bolt head facing towards the fastening bracket.

In some embodiments, each first arm has an opening through which the bolt passes. The opening may be circular or elliptical. In some embodiments, the bolt can be inserted through the opening at an intermediate stage in the assembly operation to securely locate the limiter on the cup assembly for storage and transportation prior to it being secured to the fuel injector In some embodiments, the second arm is shorter than the first arm and has at its free end a recess aligned with the opening in the first arm. In some embodiments, the recess is arcuate with its axis aligned with the axis of the opening in the first arm. This may ensure the precise location of the limiter on the fastening bracket prior to final assembly.

In some embodiments, the limiter is formed of a resilient material which assists in the uniform distribution of the clamping forces. The limiter may comprise stainless steel or a coated carbon steel.

In some embodiments, the fastening bracket has a central opening which fits over the main body of the injector cup to abut the flange so that the inner periphery defined by the central opening lies on the flange, the outer periphery of the fastening bracket having a greater thickness than the inner periphery, the limiter being located so that the second arm is located between the thicker part of the fastening bracket and the fuel injector connector. During assembly, the contact surfaces between the flange on the injector cup and the inclination limiter first make contact on the inner periphery of the fastening bracket prior to further tightening imposing a clamping force on the outer periphery of the fastening bracket to thereby facilitate efficient contact between the clamping surfaces whilst preventing the creation of any forces tending to pivot the bolt out of the correct axial alignment.

Since the bolts are located on diametrically opposed sides of the injector cup bending moments on the injector cup and its connection to the fuel injector are effectively eliminated.

Referring now to FIG. 1, there is shown an injector cup assembly 2 having a fuel injector cup 4 formed as a one-piece body from a sheet of material. The fuel injector cup 4 is essentially cylindrically formed about an axis 6. The fuel injector cup 4 has a main body part 8 containing a volume 10 adapted to receive the fuel inlet end of a fuel injector 5 (not shown in FIG. 1). At its outer upstream end as shown in the drawings, the injector cup 4 has a coaxial tubular stub 12 having a reduced outer diameter relative to the diameter of the main body part 8 to form an annular shoulder 14. The stub contains a fuel inlet port 16 to which a fluid pipe (not shown) is connected to provide a hydraulic connection between the volume 20 and a fuel source which is typically in the form of a common rail (not shown). At its end opposite the stub 12, the volume 10 in the injector cup is open to receive the inlet end of the fuel injector 5.

Figure 2:
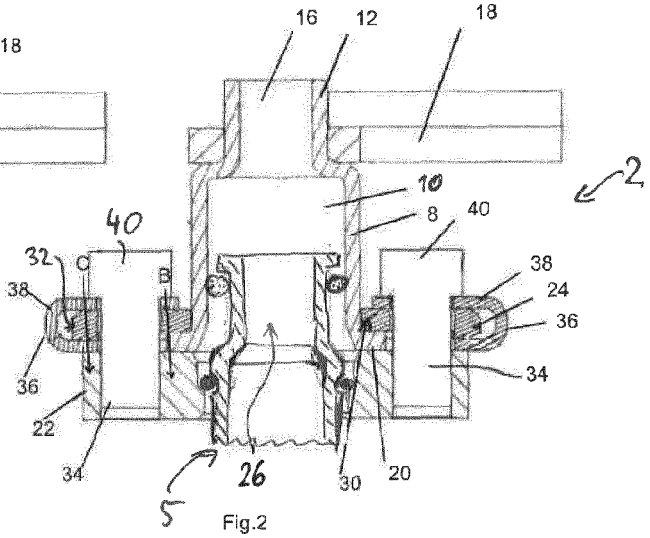
FIG. 2 shows a sectional side view of the injector cup along the line A-A of FIG. 1.
Figure 3:
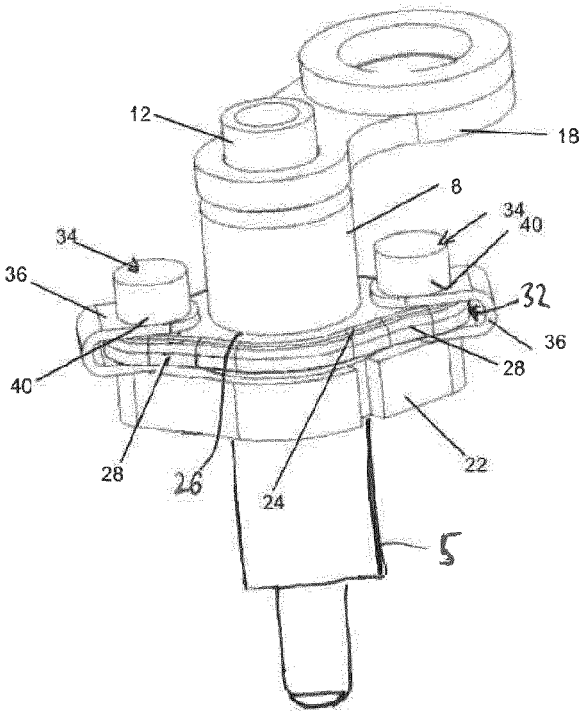
FIG. 3 shows a perspective view of the assembly.

Referring now to FIG. 2, there is a cross section of the injector cup assembly 2 of FIG. 1 along the line A-A shown in the FIG. 1. A clamping arm 18 is located on the annular shoulder 14 by which the injector cup assembly 2 is secured to the engine. The clamping arm 18 may be brazed to the injector cup 4. At its end remote from the fuel inlet port 16, the injector cup 4 has a radially outwardly extending flange 20 which is adapted to abut a connector 22, which may be part of the fuel injector 5, through which the injector cup 4 is secured to the fuel injector 5. The injector cup 4 is secured to the connector 22 through fastening bracket 24, shown particularly in FIG. 3, the fastening bracket 24 consisting of an essentially planar body having a central bore 26 and two diametrically opposed webs 28. The webs 28 each have an opening adapted to receive a bolt 34 by which the injector cup 4 is secured to the connector 22. The diameter of the bore 26 is such that the bracket 24 is a close sliding fit on the main body part 8 so that, on assembly, it can slide down the main body 8 to abut and lie on one axial side of the flange 20. The connector 22 abuts the opposite axial side of the flange 20. The bolts 34 are screwed into the connector 22.

The inner periphery 30 of the bracket 24 around the central bore 26 is thinner than the outer periphery 32 of the bracket 24 as shown in FIG. 2. There is inherently a tendency, when the bolts 34 are tightened to secure the injector cup to the fuel injector, for the flange 20 to be deflected or bent downwardly which tends to reduce the contact area between the clamping surfaces which increases the risk of fuel leakages. Any deflection of the flange 20 biases the bolts 34 to also adopt a slight inclination which also acts in a direction to reduce the contact area. Furthermore, the hydraulic pressure in the fuel flow from the common rail to the fuel injector urges the injector cup 4 in a vertical direction along its central axis away from the fuel injector. These forces tend to bend the flange 20 downwardly and any such bending reduces the contact area between the flange 20 and the connector 22.

Figure 4:
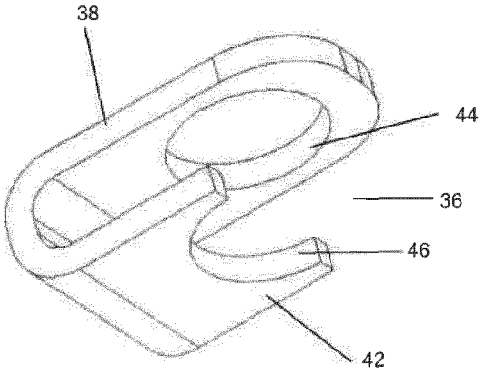
FIG. 4 shows a perspective view of an inclination limiter incorporating teachings of the present disclosure.

To minimise this movement of the fastening bracket 24 and hence the bolts 34, and to minimise the forces acting to reduce the contact area, an inclination limiting clip 36 is located on each web 28 of the fastening bracket 24. The clip 36, as shown in FIGS. 2 and 4, is U-shaped in cross-section. It is formed from a planar material such as sheet steel and comprises a first arm 38 which in use is located between the bolt head 40 and the fastening bracket 24 and a second arm 42 which is essentially parallel to the first arm and to which it is joined by a web located on the outside of the fastening bracket 24. The second arm 42 lies between the thicker outer periphery 32 of the fastening bracket 24 and the connector 22 of the fuel injector.

The first arm 38 has an opening 44 in the form of a bore with an axis through which the bolt 34 passes and the second arm 42 has on its free end an arcuate recess 46 the axis of which is aligned with the axis of the opening 44. During assembly to the fuel injector and for transport purposes, the limiter 36 is retained on the injector cup assembly 4 by the bolt 34.

When being assembled, as the bolts 34 are tightened, the bolt head 40 first of all makes contact with the thinner inner periphery 30 of the central bore 26 in the fastening bracket 24 which overlies the flange 20 on the injector cup 4. That the bolt head 40 "makes contact with the thinner inner periphery 30" means in particular, that it presses the free end of the first arm 38 against the fastening bracket 24 in the region of the inner periphery 30 so that the first arm 38 in turn presses the fastening bracket 24 against the flange 20. This generates a first clamping force indicated by the arrow B on FIG. 2 which results in a plastic deformation effect between the flange 20 and the fuel injector connector 22 which allows a good contact path and hence a good hydraulic seal between the connector 22 and the injector cup 4. The plastic deformation also compensates for the inevitable manufacturing tolerances in the production of each component.

A further tightening of the bolts 34 results in a clamping force on the outer periphery 32 of the fastening bracket 24 where the first arm 38, the thicker periphery 32 of the fastening bracket 24 and the lower second arm 42 are clamped securely to the connector with a second force indicated by the arrow C. This arrangement minimises the risk of movement of the connector injector cup 4 relative to the fuel injector by axial movement away from the fuel injector, as deflection of the flange 20 and the fastening bracket 24 are effectively minimised because the clamping force of the bolts 34 is effectively along the axis of the bolt, which is parallel to the axis of the connector injector cup 4. Since the bolts are located on diametrically opposed sides of the injector cup 4, bending moments on the injector cup and its connection are effectively eliminated.

Although the embodiment described utilises two bolts as the fastening devices it will be understood that other types and numbers of fastening devices may be used. For example, three bolts may be disposed equidistantly about the periphery of the injector cup. Other types of fastening device may comprise screws, over-centre clamps and/or spring clips.

What is claimed is:

1. A fuel injector assembly for an internal combustion engine, the assembly comprising:

an injector cup with an internal volume to receive a fuel inlet end of a fuel injector and a fuel inlet port for hydraulic connection to a fuel source;

a securing device to fasten the injector cup to the engine;

wherein a first end of the injector cup remote from the fuel inlet port comprises an outwardly extending flange;

a connector abutting the flange, wherein the injector cup and the fuel injector are secured together through the connector;

a fastening bracket supported on the flange, wherein the injector cup and the connector are secured through the fastening bracket by a fastening device;

wherein the fastening device comprises a U-shaped clip with a first arm disposed between a clamping face of the fastening device and the fastening bracket and a second arm generally parallel to the first arm disposed on the opposite side of the fastening bracket.

2. A fuel injector assembly according to claim 1, wherein the second arm is disposed on the opposite side of the fastening bracket between the fastening bracket and the connector.

3. A fuel injector assembly according to claim 1, further comprising the fuel injector;

wherein the fuel injector comprises the connector blocks axial displacement of the fuel inlet end of the fuel injector with respect to the injector cup in direction away from the fuel inlet port.

4. A fuel injector assembly according to claim 1, further comprising a second fastening device located on an opposed side of the injector cup with respect to the fastening device.

5. A fuel injector assembly according to claim 1, wherein the fastening device comprises a bolt;

wherein the first arm is disposed between a bolt head and the fastening bracket.

6. A fuel injector assembly according to claim 5, wherein the first arm defines an opening through which the bolt passes.

7. A fuel injector assembly according to claim 6, wherein the second arm is shorter than the first arm and has at a free end a recess aligned with the opening in the first arm.

8. A fuel injector assembly according to claim 7, wherein the recess has an arcuate shape.

9. A fuel injector assembly according to claim 1, wherein the clip comprises a resilient material.

10. A fuel injector assembly according to claim 1, wherein the clip comprises stainless steel or a coated carbon steel.

11. A fuel injector assembly according to claim 1, wherein:

the fastening bracket defines a central opening fitting over the main body part of the injector cup to abut the flange so an inner periphery of the fastening bracket defined by the central opening lies on the flange;

the outer periphery of the fastening bracket has a greater thickness than the inner periphery;

the clip located so that the second arm is between the thicker outer periphery of the fastening bracket and the fuel injector connector.

* * * * *